US006189698B1

(12) United States Patent
Asser

(10) Patent No.: US 6,189,698 B1
(45) Date of Patent: Feb. 20, 2001

(54) COSMETICS ORGANIZER AND KIT FOR MAKING SAME

(76) Inventor: Diane Asser, 2056 Hunters Field Rd., St. Louis, MO (US) 63122-2279

( * ) Notice: Under 35 U.S.C. 154(b), the term of this patent shall be extended for 0 days.

(21) Appl. No.: 09/374,314

(22) Filed: Aug. 13, 1999

(51) Int. Cl.[7] ..... B65D 85/00; A45D 33/00
(52) U.S. Cl. ..... 206/581; 132/314; 206/823
(58) Field of Search ..... 15/210.1; 30/452, 30/459; 62/457.2; 132/288, 294–297, 314, 315; 150/128; 206/1.7–1.9, 235, 581, 823; 248/205.2; 40/312

(56) References Cited

U.S. PATENT DOCUMENTS

| | | | | |
|---|---|---|---|---|
| 2,563,455 | | 8/1951 | Brown | 220/20 |
| 3,441,033 | | 4/1969 | Flax | 132/82 |
| 4,250,938 | | 2/1981 | Siegel | 150/35 |
| 4,285,150 | * | 8/1981 | Richardson et al. | 40/312 |
| 4,574,960 | * | 3/1986 | Shikatani | 211/60.1 |
| 4,884,680 | * | 12/1989 | Israel et al. | 206/1.9 |
| 4,917,130 | * | 4/1990 | Sweder | 132/288 |
| 4,960,204 | | 10/1990 | Young et al. | 206/235 |
| 5,167,071 | * | 12/1992 | Eisen | 30/452 |
| 5,207,254 | | 5/1993 | Fromm | 150/104 |
| 5,242,063 | * | 9/1993 | Ericksen et al. | 248/205.2 |
| 5,255,833 | * | 10/1993 | McAllister | 150/128 |
| 5,329,947 | * | 7/1994 | Shikler | 132/314 |
| 5,341,538 | * | 8/1994 | Banome | 15/210.1 |
| 5,361,603 | * | 11/1994 | Merritt-Munson | 62/457.2 |
| 5,484,637 | * | 1/1996 | Paragon et al. | 206/1.9 |
| 5,590,785 | * | 1/1997 | Seitzinger | 206/1.8 |
| 5,727,323 | * | 3/1998 | Cerrato | 30/459 |
| 5,813,420 | * | 9/1998 | Sussman | 132/294 |

* cited by examiner

*Primary Examiner*—Jim Foster
(74) *Attorney, Agent, or Firm*—Gregory E. Upchurch; Dennis J.M. Donahue, III; Thompson Coburn, LLP

(57) ABSTRACT

A cosmetics organizer comprising a palette, hook and loop fasteners having mating halves, and at least one cosmetic item removably secured to the palette by hook and loop fasteners wherein one mating half of each fastener is secured to the palette and the other mating half is secured to said cosmetic item. The invention also encompasses a kit for the creation of a cosmetics organizer, said kit comprising a palette and hook and loop fasteners having mating halves wherein the user of the kit can secure one mating half of each fastener to the palette and the other mating half to a cosmetic item to removably secure the cosmetic item to the palette.

16 Claims, 3 Drawing Sheets

COSMETICS ORGANIZER AND KIT FOR MAKING SAME

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Technical Field

This invention relates to the field of organizers for cosmetics and the like and seeks to address numerous problems with the prior art. For example, the most common cosmetic carrying system is a simple bag with a large mouthed closure, usually a zipper. While convenient to load, such bags make locating specific items difficult. Also, there is no way of easily identifying if a specific item is missing from the bag. And, of course, there is no way of having access to all of the items in the bag at the same time.

Another problem with prior articles is that they are often bulky and inconvenient to pack and carry for traveling when loaded with cosmetics. And, depending on the size of the bag, it may not accommodate cosmetic products of varying sizes and shapes. For example, U.S. Pat. No. 2,563,455 teaches an organizer having holes therein for holding the cosmetics. Such an organizer is bulky, does not hold the cosmetics securely in place and cannot accommodate unusually sized items.

Finally, the prior articles lack the ability to be customized by the end user. For example, vision or dexterity impaired individuals may need consistent spacing and organization of their cosmetics, qualities which are unattainable with the prior art.

BRIEF SUMMARY OF THE INVENTION

The preferred embodiment of the invention includes a palette, hook and loop fasteners, and at least one cosmetic item. The kit embodiment of the invention includes at least a palette and self-adhesive hook and loop fasteners.

One goal of the invention is to provide a cosmetics organizer that is dual purpose in that it can be used for both home and travel without packing and unpacking.

Another goal of the invention is a cosmetic organizer that packs flat for easy storage, for example, in suitcases, tote bags, even legal sized file folders in a desk.

Another goal is an organizer that works with a variety of cosmetics products of varying shapes and sizes.

Another goal is an organizer that quickly and conveniently displays all the attached cosmetics for ease and quickness of use and for quick indication of missing cosmetic items.

Another goal is to provide for a convenient organizer for vision impaired individuals through the use of the stable palette surface which makes it easier to identify and select cosmetic items of similar shape or color.

Another goal is to provide an organizer which allows for the application of cosmetics with one hand while holding all the necessary cosmetics with the organizer in the other hand.

Another goal is to provide an organizer for users who desire an organizer which is easy to carry, convenient, and which will allow for quick identification of missing items, for example, college dormitory students.

Other objects and features will be in part apparent and in part pointed out hereinafter.

BRIEF DESCRIPTION OF THE DRAWINGS

Similar reference characters indicate similar parts throughout the several views of the drawings.

DETAILED DESCRIPTION OF THE INVENTION AND MODE(S) FOR CARRYING OUT THE INVENTION

Figure 1:
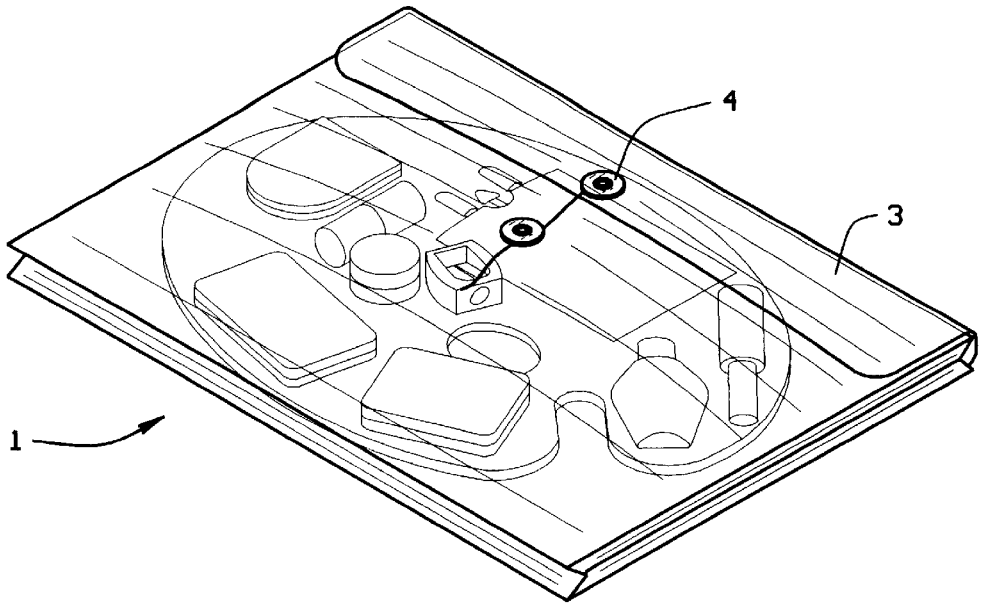
FIG. 1 is a perspective view of the cosmetic organizer including the carrying pouch.
Figure 2:
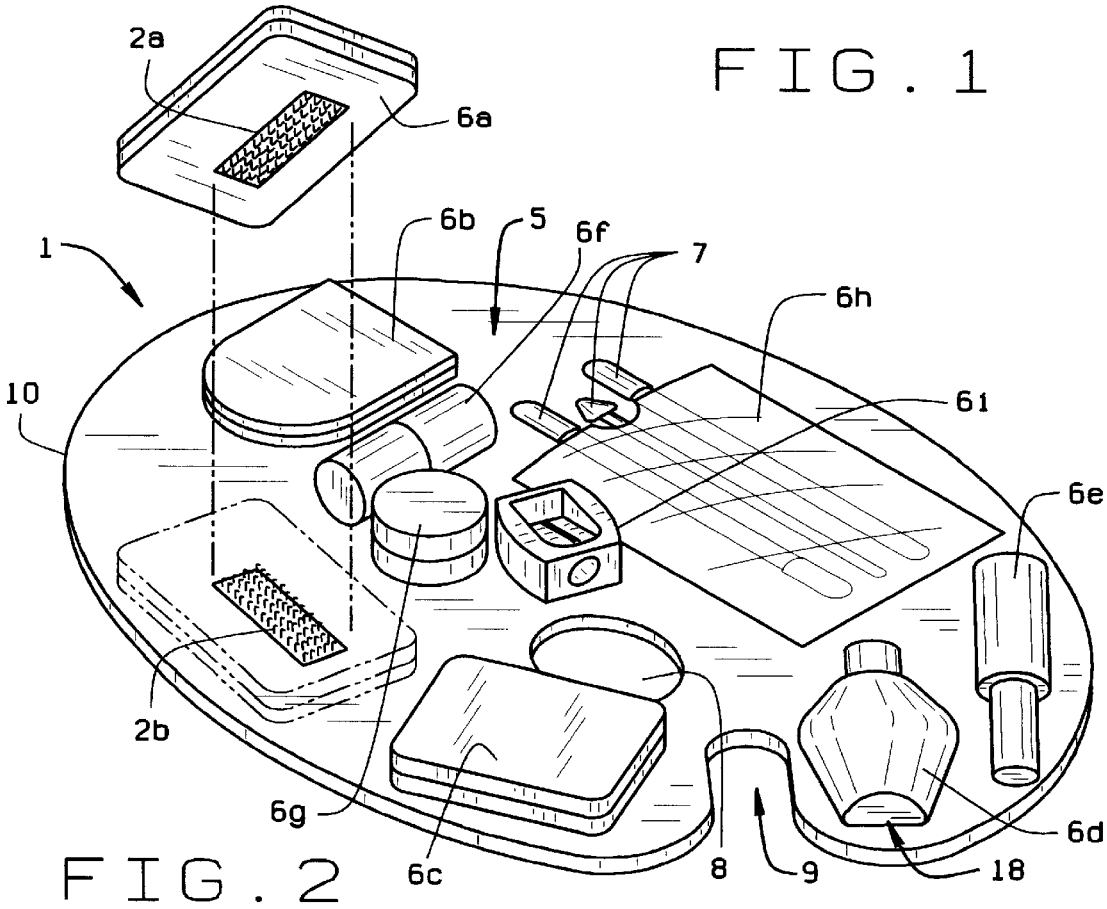
FIG. 2 is a perspective view of the palette of the organizer showing attached cosmetic items and the hook and loop attachment mechanism.

A cosmetics organizer 1 of the present invention includes a palette 10, hook and loop fasteners 2 having mating halves 2*a* and 2*b* and at least one cosmetic item, generally 6 and specifically 6*a* through 6*i*. Each cosmetic item 6 is removably secured to the palette 10 by at least one hook and loop fastener 2 wherein one mating half 2*b* of each fastener is secured to the palette 10 and the other mating half 2*a* is secured to said cosmetic item 6. In the preferred embodiment, the palette contains a thumbhole 8 and a finger cutout 9 to allow for effective one handed control of the organizer 1.

Figure 3:
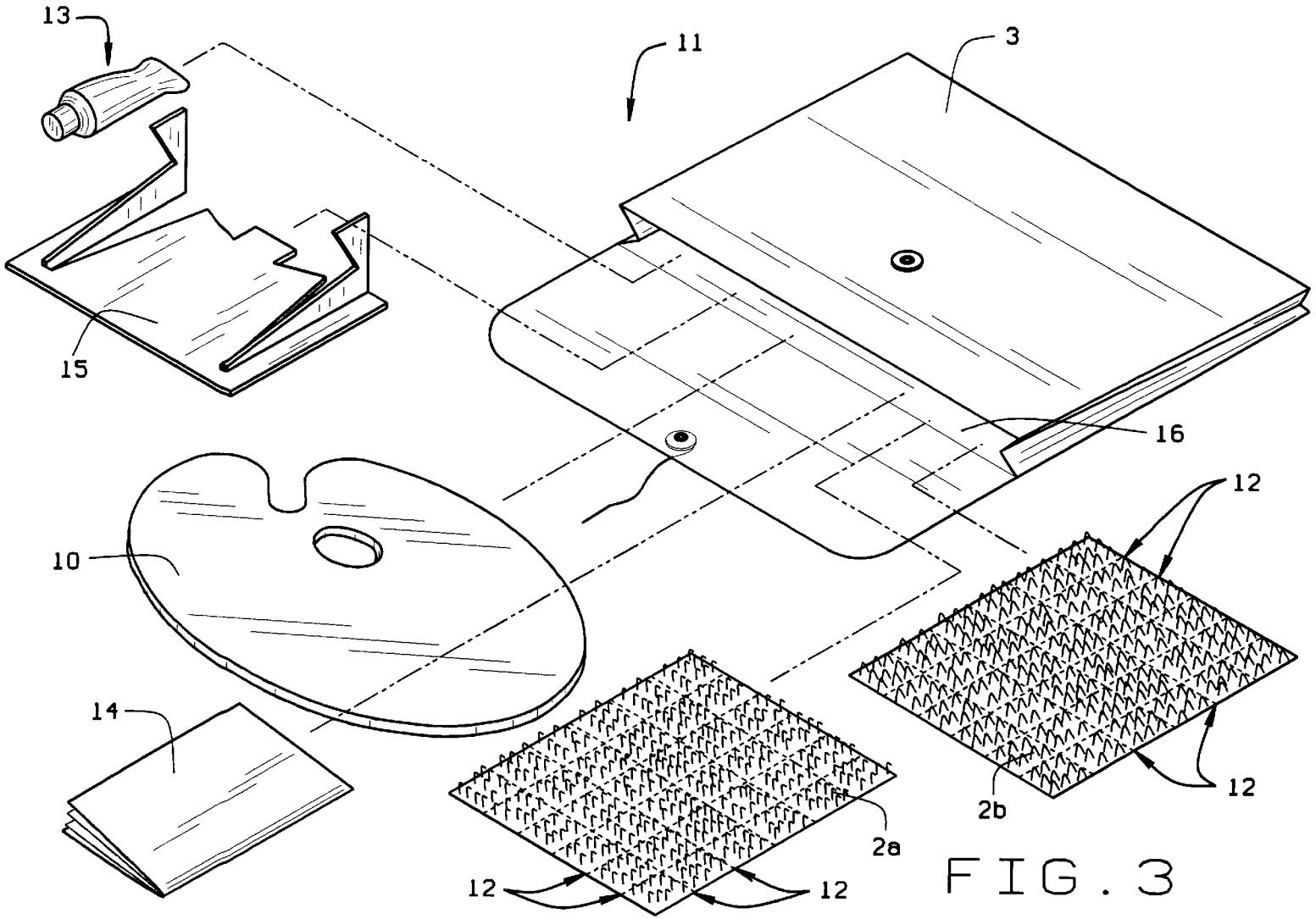
FIG. 3 is an exploded view of an embodiment of the kit form of the invention.

The invention also encompasses a kit 11 for the creation of a cosmetics organizer 1, said kit 11 comprising a palette 10 and hook and loop fasteners 2 having mating halves 2*a* and 2*b*. The fasteners 2 are self-adhesive such that the user of the kit can secure one mating half 2*b* of each fastener 2 to the palette 10 and the other mating half 2*a* to a cosmetic item 6. In this way, the user may removably secure the cosmetic item 6 to the palette 10. Also, when in sheet form, as shown in FIG. 3, the fasteners 2 may contain score lines, perforations, or other such marks 12 indicating where the user may cut or otherwise separate the sheet into smaller sections for application to the items 6 and the palette 10.

Also, in the kit form of the invention, the user will have to place the fasteners 2 herself, thus, the kit 11 may include a package of adhesive cleaner 13 to prepare the surfaces of the palette 10 and the cosmetic items 6 for application of the fasteners 2. It may also include an instruction manual 14 explaining to the user how to assemble the organizer 1 from the pieces included in the kit 11.

Alternative embodiments of the invention include a palette 10 with a reflective or mirrored surface 5 in which the user may view herself to apply the cosmetic items 6. This surface is shown in the drawings as the top surface 5 of the palette 10, however, this alternative and others may apply to the bottom surface as well. Also, the surface 5 of the palette 10 may, if desired, be made to be compatible with printed indicia or labels of any type including handwriting, laser or inkjet printing, screen printing, paint, etc. As such, the palette 10 could be customized for the user or groups of users, such as sororities. Of course, the palette 10 can also be manufactured in various colors and textures to suit the users' needs or desires.

The organizer may, if desired, also include a pouch 3 with a pocket 16 to store and transport the palette 10 with the attached cosmetic items 6. In the preferred embodiment, the pouch 3 is 10.5" by 15" and is made of an easy to clean material such as vinyl, plastic or see through mesh. Also, the pouch 3 can be substantially transparent to aid in viewing and selection of the cosmetic items 6. The pouch 3 may also contain a closure 4 to secure the palette and cosmetic items therein. In the preferred embodiment, the closure is a string tie and button closure 4, although zippers, hook and loop fastener, snaps, a tab and slot or any other suitable arrangement would also be acceptable.

Figure 4:
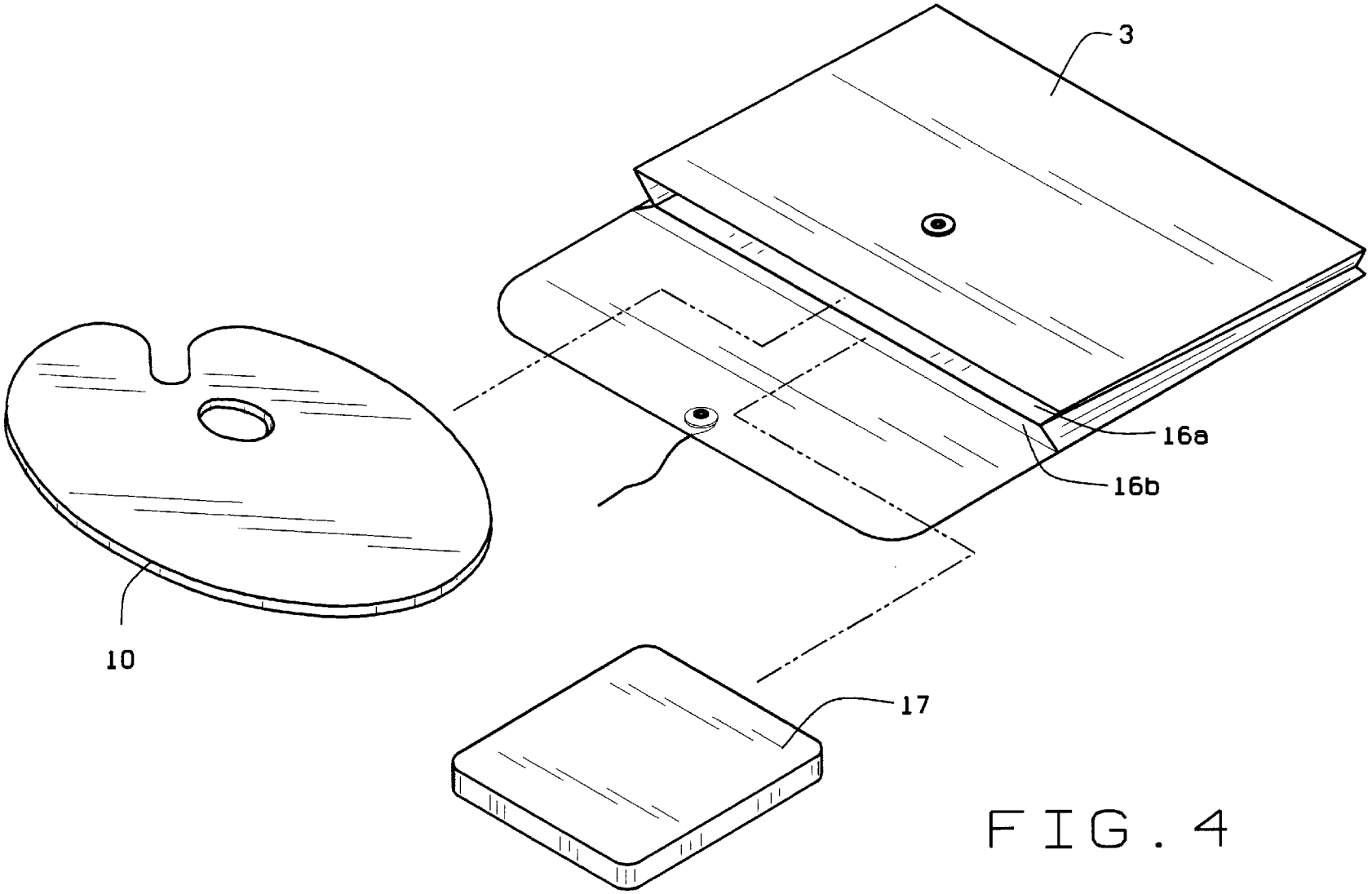
FIG. 4 is an exploded view of an alternate embodiment of the invention.

As shown in FIG. 4, the pouch 3 may, if desired, contain two pockets 16*a* and 16*b*. The palette 10 with secured cosmetic items 6 can be stored in one pocket while other travel items—toothbrush, shampoo, etc.—can be stored in the other pocket. Alternatively, one pocket may house a cold pack 17 sized to fit in a pocket in place of the other travel items. In this way, the cosmetic items can be kept cool by the cold pack 17 in hot climates.

As shown in FIG. 3, the organizer may, if desired, also contain a stand or easel 15 for the palette which would allow the palette 10 to stand upright to display the cosmetic items 6 secured thereto in a more prominent manner. As shown, this stand 15 may be collapsible for carrying inside the pouch 3.

The cosmetic items 6 may also be tailored to fit the user's needs. For example, one of the cosmetic items 6*h* may be a carrier 6*h* for small cosmetic items such as brushes or pencils 7. In this way, the smaller items do not need to be separately mounted, but are still securely contained within the organizer 1. Although not shown in the drawings, in the preferred embodiment, the carrier 6*h* has a closure consisting of hook and loop fasteners, although string tie and button closure, zippers, snaps, tab and slot or any other suitable arrangement would also be acceptable.

Also, the cosmetic items 6 may include a mirror or mirrored compact 6*c*, as well as a pencil sharpener 6*i*. And they may also include transfer containers 6*d*. These transfer containers 6*d* may be used to transfer material, such as shampoo, from larger in-home bottles to allow them to be used with the organizer 1. As shown in FIG. 1, to further increase the convenience of their use with the organizer 1, these transfer containers 6*d* can have flat backs 18 for mounting to the palette 10.

Another embodiment of the invention is a cosmetic organizer for children. In this embodiment, the organizer 1 is sized appropriately for a child's hands and the cosmetic items 6 are non-toxic or simply play cosmetics.

In view of the above, it will be seen that the several objects of the invention are achieved and other advantages are attained. As various changes could be made in the above construction without departing from the scope of the invention, it is intended that all matter contained in the above description shall be interpreted as illustrative and not limiting.

I claim:

1. A cosmetics organizer comprising:

a portable palette having a peripheral edge, a substantially flat top surface extending over an entire area defined by the edge, a finger cutout at the edge and a thumb hole spaced from the cutout;

a plurality of spaced hook and loop fasteners, each fastener having mating halves; and a plurality of cosmetic items spaced apart on the top surface, the cosmetic items removably secured to the palette by the plurality of hook and loop fasteners wherein one mating half of each fastener is secured to the palette and the other mating half is secured to one of the cosmetic items, thereby allowing the user to selectively secure the cosmetic items to the palette.

2. The apparatus of claim 1 further comprising a pouch sized to contain the palette with the cosmetic items removably secured thereto.

3. The apparatus of claim 2 wherein the pouch is created of a substantially transparent material.

4. The apparatus of claim 2 wherein the pouch has a closure.

5. The apparatus of claim 2 wherein the pouch has two pockets, the first pocket being of a size to contain the palette with the cosmetic items removably secured thereto.

6. The apparatus of claim 5 further comprising a cold pack sized to fit in the second pocket of the pouch for cooling the cosmetic items.

7. A kit for the creation of a cosmetics organizer for use with a plurality of cosmetic items, said kit comprising:

a portable palette;

a sheet of hook and loop fasteners having mating halves for the user of said kit to secure one mating half of each fastener to the palette and the other mating half to a cosmetic item to removably secure the cosmetic item to the palette, the sheet being separated by weakened lines;

a cleaner for cleaning the palette;

an instruction brochure explaining how to create said cosmetics organizer using the palette and the fasteners with said cosmetic items; and a container containing the palette, the sheet the cleaner, and the instruction brochure.

8. The apparatus of claims 7 further comprising transfer containers having flat back surfaces, said back surfaces to be removably secured to the palette by the hook and loop fastener.

9. The apparatus of claim 7 wherein the hook and loop fasteners are self-adhesive.

10. The apparatus of claims 7 further comprising a stand for holding the palette with the cosmetic items removably secured thereto.

11. The apparatus of claims 1 or 7 wherein at least one of the cosmetic items is a carrier for the storage of small cosmetic items, said carrier having a closure.

12. The apparatus of claims 1 or 7 wherein the palette has a reflective surface in which the user of said organizer can view herself to apply cosmetics.

13. The apparatus of claims 1 or 7 wherein at least one of the cosmetic items is a mirror.

14. The apparatus of claims 1 or 7 wherein at least one of the cosmetic items is a pencil sharpener.

15. The apparatus of claims 1 and 7 wherein at least one surface of the palette is compatible with printed indicia thereon.

16. The apparatus of claims 1 or 7 wherein at least one surface of the palette is compatible with stickers or labels thereon.

* * * * *